US010249986B2

(12) United States Patent
Miyamura et al.

(10) Patent No.: US 10,249,986 B2
(45) Date of Patent: Apr. 2, 2019

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Yasuo Omori, Mie (JP); Hajime Matsui, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 52 days.

(21) Appl. No.: 15/546,083

(22) PCT Filed: Jan. 18, 2016

(86) PCT No.: PCT/JP2016/051213
§ 371 (c)(1),
(2) Date: Jul. 25, 2017

(87) PCT Pub. No.: WO2016/125565
PCT Pub. Date: Aug. 11, 2016

(65) Prior Publication Data

US 2018/0337491 A1 Nov. 22, 2018

(30) Foreign Application Priority Data

Feb. 6, 2015 (JP) ..... 2015-021881

(51) Int. Cl.
*H01R 13/639* (2006.01)
*H01R 13/42* (2006.01)
(Continued)

(52) U.S. Cl.
CPC ..... *H01R 13/6278* (2013.01); *H01R 13/4223* (2013.01); *H01R 2201/26* (2013.01)

(58) Field of Classification Search
CPC ..... H01R 13/4362; H01R 13/4364; H01R 13/6273; H01R 13/4367; H01R 13/4223
See application file for complete search history.

(56) References Cited

U.S. PATENT DOCUMENTS 5,913,703 A * 6/1999 Suzuki ..... H01R 13/518 439/489
6,652,328 B2 * 11/2003 Suzuki ..... H01R 13/4365 439/595

(Continued)

FOREIGN PATENT DOCUMENTS

| | | |
|---|---|---|
| JP | 11-97108 | 4/1999 |
| JP | 2003-317867 | 11/2003 |
| JP | 2014-207102 | 10/2014 |

OTHER PUBLICATIONS

International Search Report dated Mar. 29, 2016.

*Primary Examiner* — Briggitte R Hammond
(74) *Attorney, Agent, or Firm* — Gerald E. Hespos; Michael J. Porco; Matthew T. Hespos

(57) ABSTRACT

It is aimed to prevent connectors in a connected state from being easily separated. A connector (A) includes a male housing (10) including a receptacle (12), a female housing (30) to be connected to the male housing (10) by being inserted into the receptacle (12), and a retainer (36) (movable locking member, locking means) and a lock receiving portion (19) (locking means) provided on the male housing (10) and the female housing (30) and configured to lock the male housing (10) and the female housing (30) in a connected state by being locked inside the receptacle (12). The
(Continued)

locking of the retainer (36) and the lock receiving portion (19) is released by an unlocking tool (40) inserted into the receptacle (12).

5 Claims, 12 Drawing Sheets

(51) Int. Cl.
*H01R 13/62* (2006.01)
*H01R 13/627* (2006.01)
*H01R 13/422* (2006.01)

(56) References Cited

U.S. PATENT DOCUMENTS 7,140,908 B2 * 11/2006 Katsuma ..... H01R 13/4364 439/489
7,556,539 B2 * 7/2009 Takahashi ..... H01R 13/4362 439/752
8,083,543 B2 * 12/2011 Omori ..... H01R 31/08 439/511
9,281,605 B2 * 3/2016 Boemmel ..... H01R 13/516
2005/0245124 A1 * 11/2005 Katsuma ..... H01R 13/6272 439/357
2011/0008989 A1 * 1/2011 Amano ..... H01R 13/6272 439/357
2012/0225574 A1 * 9/2012 Nakamura ..... H01R 13/4223 439/345
2015/0295343 A1 * 10/2015 Suzuki ..... H01R 13/629 439/695

* cited by examiner

CONNECTOR

BACKGROUND

1. Field of the Invention

The invention relates to a connector.

2. Description of the Related Art

Japanese Unexamined Patent Publication No. 2014-207102 discloses a connector assembly in which a female connector and a male connector are connected. The female connector is formed with a lock arm and the male connector includes a receptacle formed with a lock receiving portion. The lock arm deflects resiliently due to interference with the lock receiving portion in the process of connecting the connectors. The lock arm resiliently returns and is locked to the lock receiving portion when the connectors reach a properly connected state. Thus, the male and female connectors are locked in the connected state by this locking action.

The male and female connectors of the above-described connector assembly that have been connected can be separated by unlocking the lock arm and directly pulling the connectors apart. Thus, a worker can easily perform a separating operation of the connectors. The connector assembly may constitute part of an automotive wiring harness. In this situation, it is preferable in terms of work efficiency if a mechanic who performs maintenance can separate the connectors easily. However, general users should not be able to separate the connectors out of interest. Therefore improvements are desired.

The invention was completed in view of the above situation and aims to prevent connectors in a connected state from being separated easily.

SUMMARY

The invention is directed to a connector with a male housing including a receptacle and a female housing to be connected to the male housing by being inserted into the receptacle. A locking means is provided on the male housing and the female housing and is configured to lock the male housing and the female housing in a connected state by being locked inside the receptacle. The locking of the locking means is released by an unlocking tool inserted into the receptacle.

The locking means for locking the male housing and the female housing in the connected state are accommodated inside the receptacle. Thus, the locking structure cannot be confirmed visually confirmed. General users who do not recognize the necessity of the unlocking tool and who do not possess the unlocking tool cannot separate the housings.

The female housing may include a housing body for accommodating a female terminal fitting. A movable locking member may be relatively movable with respect to the housing body and may constitute the locking means. The movable locking member may be displaced to a position to be disengaged from the locking means on the male housing by the unlocking tool. According to this configuration, the housings can be separated if the movable locking member is disengaged from the locking means on the male housing by the unlocking tool.

The housing body may be formed with a locking lance for retaining and locking the accommodated female terminal fitting. The movable locking member may have a function of retaining the female terminal fitting accommodated in the female housing. According to this configuration, the movable locking member also has the function of retaining the female terminal fitting. Thus, the number of components is reduced as compared to the case where a dedicated member for retaining the female terminal fitting is provided.

A resilient pressing piece may be provided in the receptacle for displacing the movable locking member to a position where the movable locking member is locked to the locking means on the male housing side when the male and female housings are connected. According to this configuration, when the housings are connected, the movable locking member is locked to the locking means on the male housing by the resilient pressing piece. Thus, a worker need not perform an operation of displacing the movable locking member to a position where the movable locking member is locked to the locking means on the male housing.

The locking means may include a resilient locking piece formed on an inner surface of the receptacle and a locking portion formed on an outer surface of the female housing. The resilient locking piece may be deflected resiliently in a direction to be disengaged from the locking portion by the unlocking tool. According to this configuration, the housings can be separated if the resilient locking piece is disengaged from the locking portion by the unlocking tool.

The unlocking tool may release the locking of the resilient locking piece and the locking portion by being displaced in the same direction as an inserting direction of the female housing into the receptacle. According to this configuration, after the unlocking tool is inserted into the receptacle and the locking of the resilient locking piece and the locking portion is released, the unlocking tool and the female housing can be separated integrally from the receptacle. Thus, man-hours of work are reduced as compared to the case where the unlocking tool is removed from the receptacle separately from the female housing.

A dummy lock arm may be formed on an outer surface of the female housing and may be configured not to lock the male housing. Additionally, a pseudo-unlocking portion may be formed on the dummy lock arm and may be exposed when the male housing and the female housing are connected. A general user may operate the pseudo-unlocking portion for the purpose of separating the housings. However, the housings cannot be separated.

DETAILED DESCRIPTION

A first embodiment of the invention is described with reference to FIGS. 1 to 7. A connector A of this first embodiment is used as a means for connecting automotive wiring harnesses, a means for connecting a device and a wiring harness or the like and includes a male housing 10 and a female housing 30 connectable to and separable from each other. Note that, in the following description, front and rear sides are defined on the basis of the male housing 10 concerning a front-rear direction. Upper and lower sides shown in FIGS. 1, 2 and 4 to 7 are directly defined as upper and lower sides concerning a vertical direction.

Figure 5:
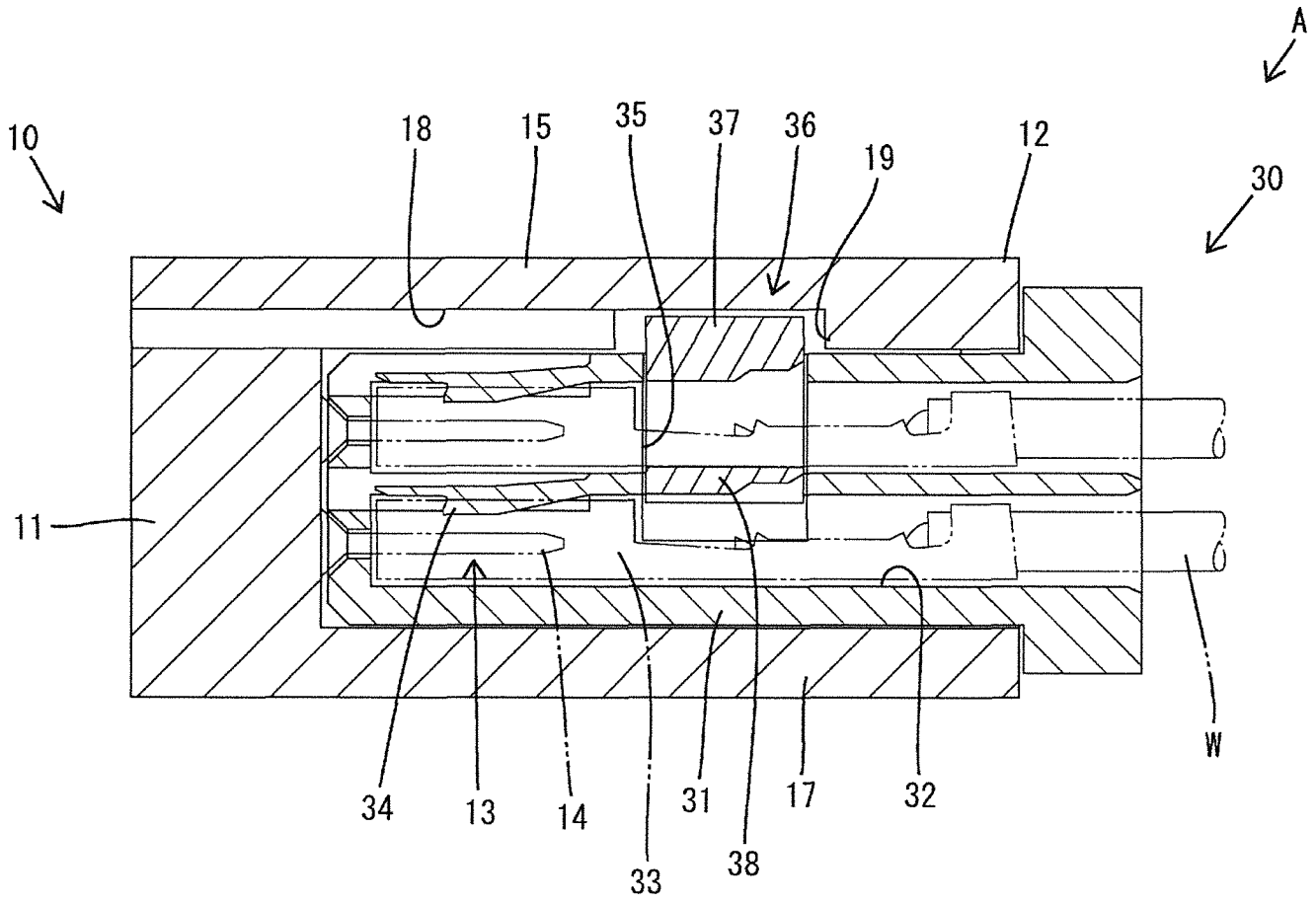
FIG. 5 is a side view in section showing a locked state where the male and female housings are connected and a retainer (movable locking member) and a lock receiving portion are locked.
Figure 7:
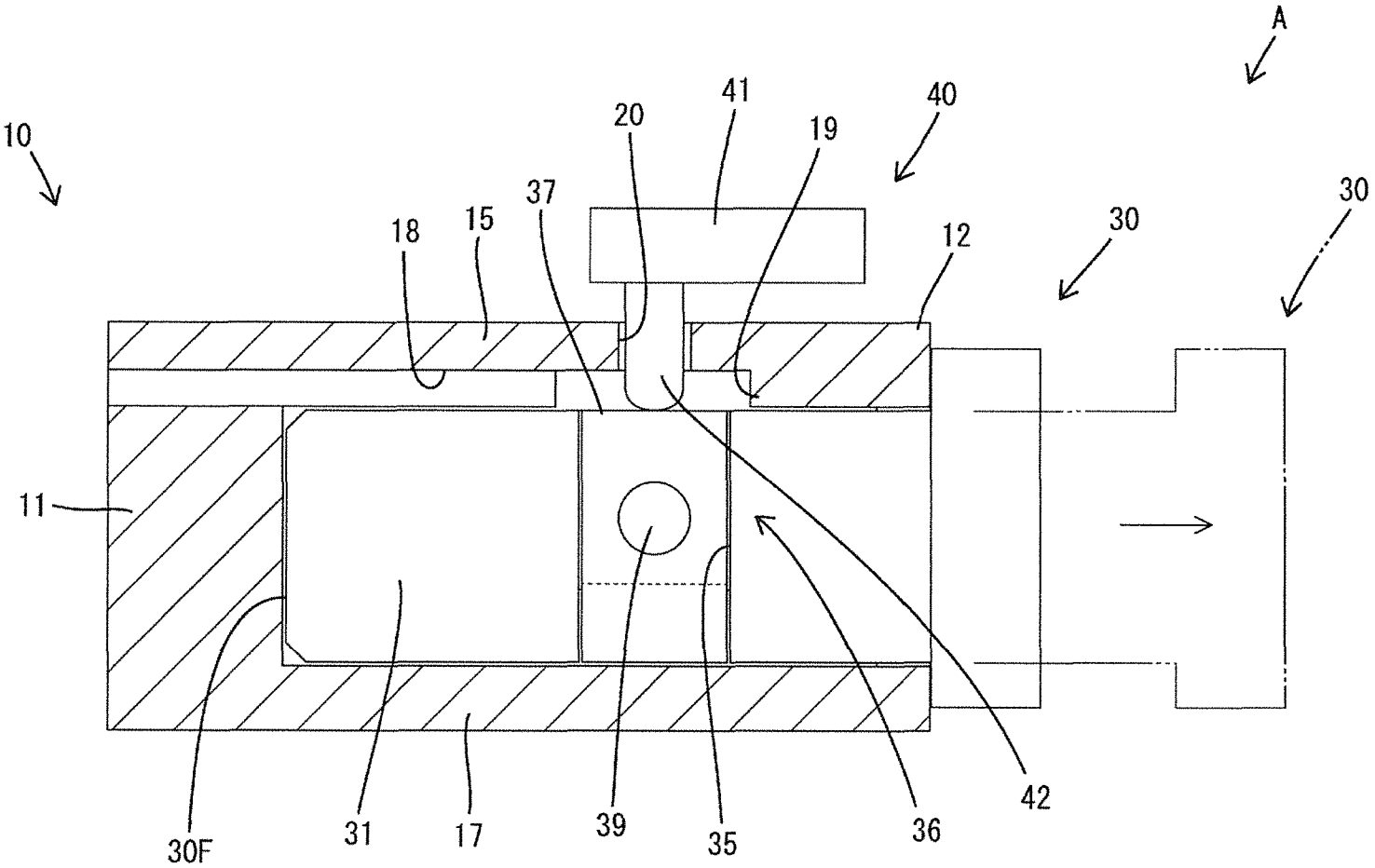
FIG. 7 is a side view in section showing a state where the locking of the retainer and the lock receiving portion is released by an unlocking tool.

The male housing 10 is made of synthetic resin and an integral assembly of a block-shaped terminal holding portion 11 and a receptacle 12 in the form of a rectangular tube cantilevered forward from the outer peripheral edge of the front end of the terminal holding portion 11, as shown in FIGS. 5 and 7. As shown in FIG. 5, male terminal fittings 13 of a known form are mounted in the terminal holding portion 11. Each male terminal fitting 13 is formed with a long and narrow tab 14 on a front end part. The tab 14 projects into the receptacle 12 from the front surface of the terminal holding portion 11.

Figure 1:
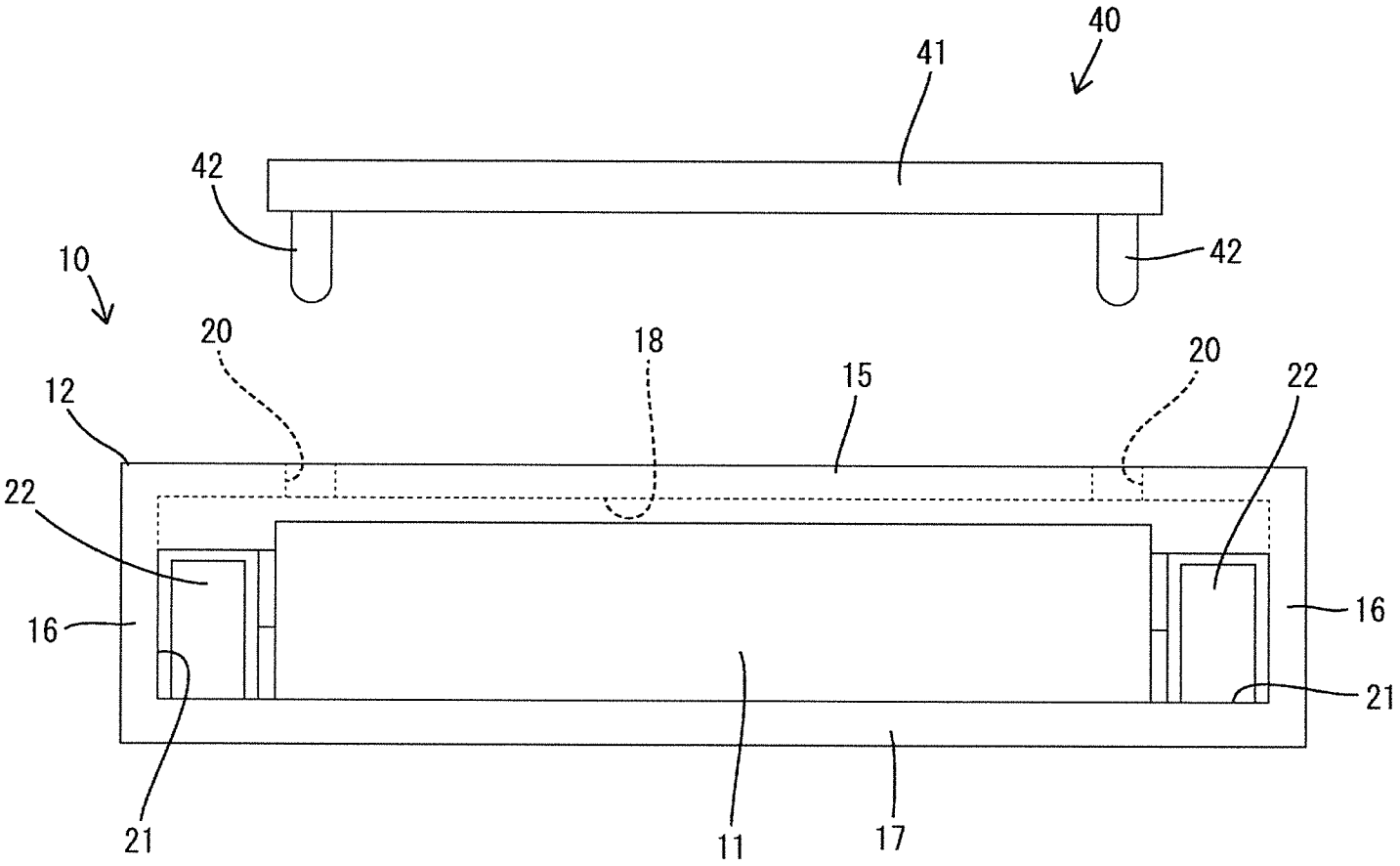
FIG. 1 is a front view of a male housing of a connector of a first embodiment.

As shown in FIG. 1, the receptacle 12 is a bilaterally symmetrical rectangular tube shape with an upper wall 15, left and right side walls 16 and a lower wall 17. As shown in FIGS. 5 and 7, the lower surface of the upper wall 15 (inner surface of the receptacle 12) is cut in an area extending from a position slightly behind the front end of the receptacle 12 to the rear end of the receptacle 12 to elevate a ceiling via a step, thereby forming a cut 18. A stepped part defines the front end surface of the cut 18 at the lower surface of the upper wall 15 defines a lock receiving portion 19 (locking means as claimed).

As shown in FIGS. 1 and 7, the upper wall 15 is formed with two bilaterally symmetrical communication holes 20 allowing communication between the inside and outside of the receptacle 12. The communication holes 20 penetrate through the upper wall 15 in the vertical direction. In a lateral direction, the communication holes 20 are arranged in an area corresponding to the cut 18. Further, in the front-rear direction, the communication holes 20 are arranged at a position corresponding to a front end part of the cut 18 (i.e. position slightly behind the lock receiving portion 19).

Figure 6:
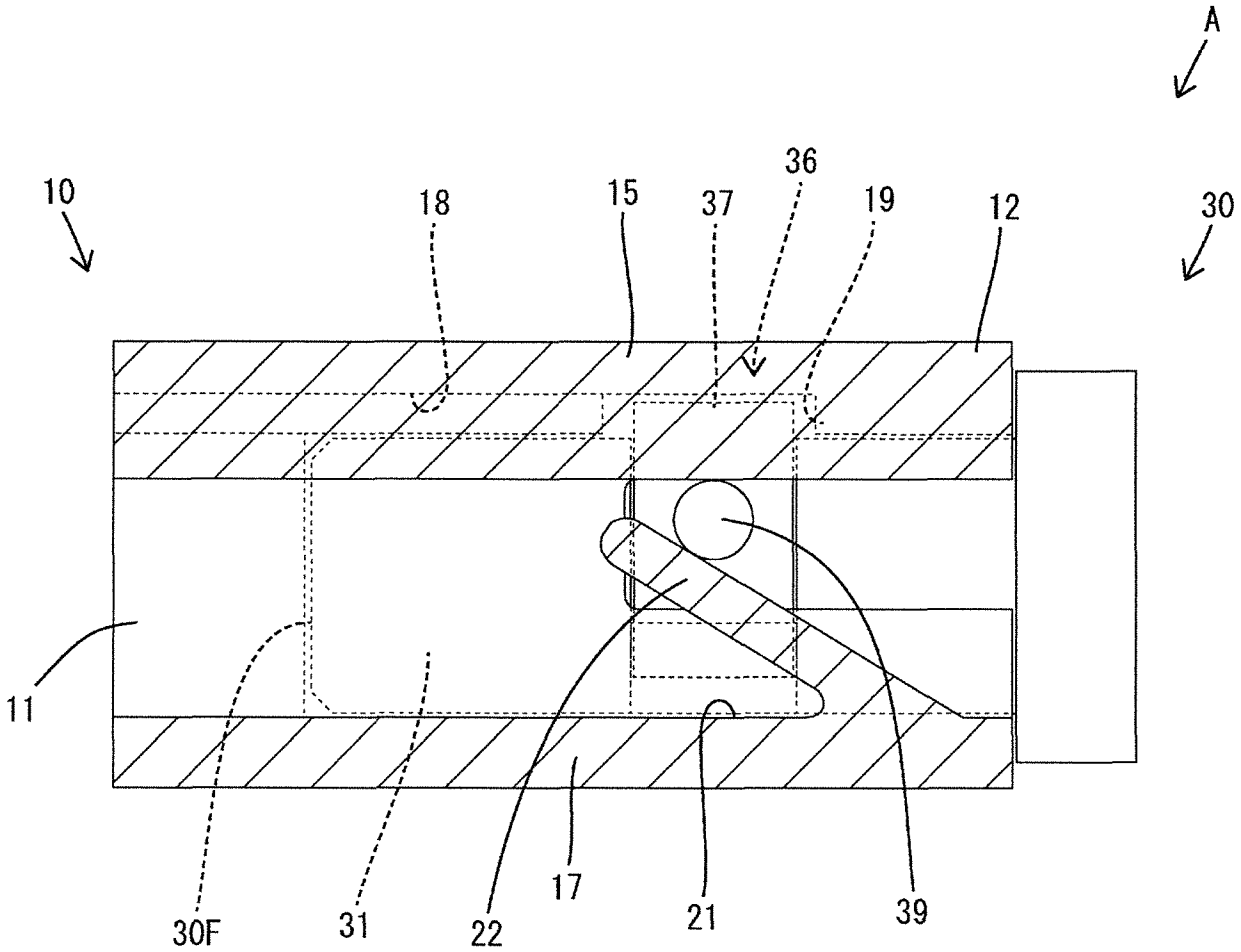
FIG. 6 is a side view in section showing a state where a resilient pressing piece pushes the retainer to a locking position with the lock receiving portion.

As shown in FIGS. 1 and 6, the left and right side walls 16 are formed with a recess 21 open in the inner surface and the front end surface thereof. A resilient pressing piece 22 is formed integrally in each recess 21. The resilient pressing piece 22 is cantilevered obliquely up to the rear from a front end position on the lower surface of the recess 21. An extending end (rear end) of the resilient pressing piece 22 is behind the lock receiving portion 19. The resilient pressing piece 22 is resiliently deflectable in the vertical direction (direction intersecting with an inserting direction of the female housing 30 into the receptacle 12) with a front end part (base end part) thereof serving as a support.

Figure 2:
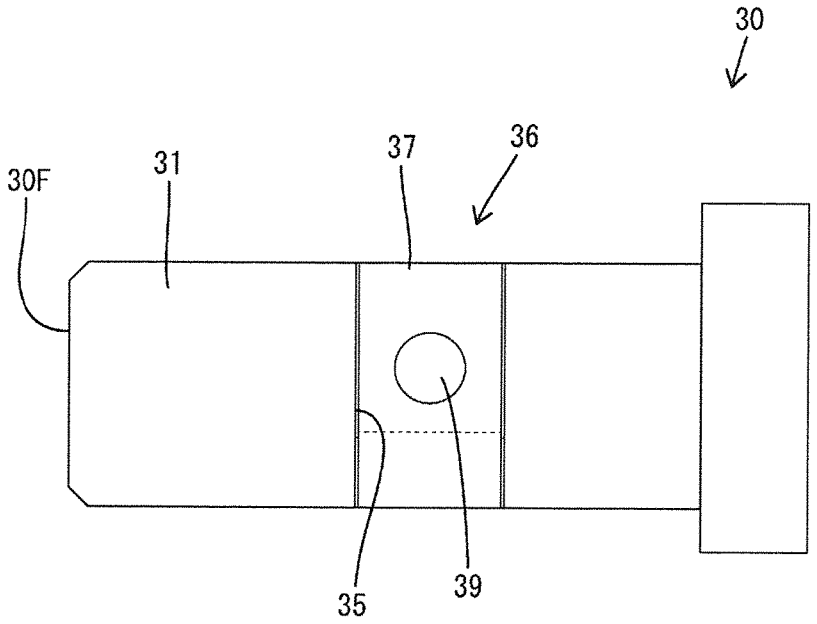
FIG. 2 is a side view of a female housing.
Figure 3:
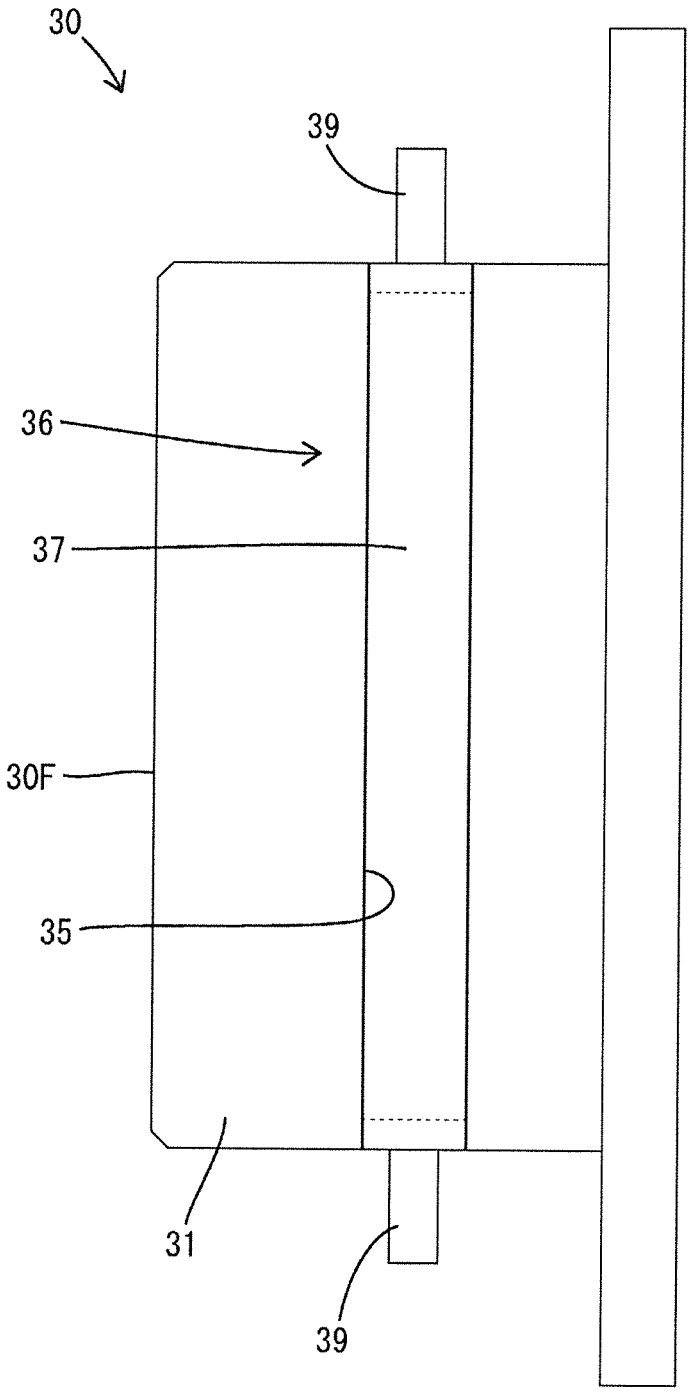
FIG. 3 is a plan view of the female housing.
Figure 4:
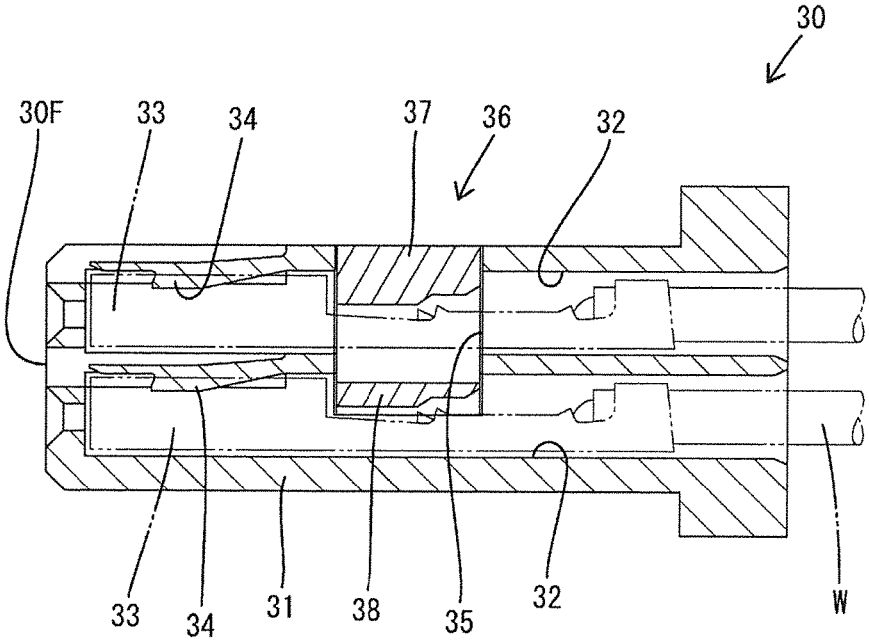
FIG. 4 is a side view in section of the female housing.

The female housing 30 is made of synthetic resin and is connected to the male housing 10 with a front surface 30F thereof facing the front surface of the male housing 10 (opening surface of the receptacle 12). As shown in FIGS. 2 to 4, the female housing 30 includes a block-shaped housing body 31 and a retainer 36 (movable locking member, locking means as claimed) removably mountable into the housing body 31. As shown in FIGS. 4 and 5, plural female terminal fittings 33 of a known form are inserted respectively into terminal accommodating chambers 32 formed in the housing body 31 to be connected to the tabs 14 of the male terminal fittings 13. The female terminal fitting 33 accommodated in the terminal accommodating chamber 32 is retained and held by a locking action of a locking lance 34 of a known form. The housing body 31 is formed with a mounting space 35 that is open in the upper surface and both left and right side surfaces thereof and communicates with all the terminal accommodating chambers 32.

As shown in FIGS. 3 to 5, the retainer 36 is formed integrally to include a body 37 extending long in the lateral direction, retaining portions 38 extending down from the body 37 and two bilaterally symmetrical pressure receiving pins 39. The retainer 36 is mounted by accommodating the retaining portions 38 into the mounting space 35 from above the housing body 31. The retainer 36 mounted in the housing body 31 is movable between a partial locking position (see FIGS. 5 and 6) and a full locking position (see FIGS. 2, 4 and 7) in the vertical direction (direction intersecting inserting and removing directions of the female housing 30 into and from the receptacle 12).

With the retainer 36 located at the partial locking position, the body 37 projects farther up than the upper surface of the housing body 31. The retaining portions 38 are retracted outward of the terminal accommodating chambers 32 (i.e. outside insertion and withdrawal paths for the female terminal fittings 33 into and from the terminal accommodating chambers 32). Thus, the female terminal fittings 33 can be inserted into the terminal accommodating chambers 32 and withdrawn from the terminal accommodating chambers 32. With the retainer 36 located at the full locking position, the body 37 and the retaining portions 38 are accommodated in the mounting space 35 and the upper surface (outer surface) of the body 37 is substantially flush with the upper surface (outer surface) of the housing body 31 or slightly lower than the upper surface of the housing body 31.

With the retainer 36 at the full locking position, the retaining portions 38 are in the terminal accommodating chambers 32 (on the insertion and withdrawal paths for the female terminal fittings 33). Thus, the female terminal fittings 33 inserted in the terminal accommodating chambers 32 are retained reliably by being locked by the retaining portions 38. Note that a retaining function by the locking action of the locking lance 34 is, even singly, sufficiently reliable against an external force in the withdrawing direction supposed to act on the female terminal fitting 33 via the wire W with the both housings 10, 30 connected. However, in connecting the housings 10, 30, a large external force in the withdrawing direction may act on the female terminal fitting 33 via the wire W when the female housing 30 is moved. Thus, the retainer 36 is moved to the full locking position at the time of connection. The pair of pressure receiving pins 39 are kept in a state projecting out in the lateral direction from both left and right side surfaces of the housing body 31 regardless of whether the retainer 36 is at the partial locking position or at the full locking position. That is, if the retainer 36 moves between the partial locking position and the full locking position, the pair of pressure receiving pins 39 are displaced in the vertical direction integrally with the body portion 37. If an upward external force acts on the pressure receiving pins 39 if with the retainer 36 located at the full locking position, the retainer 36 is moved to the partial locking position.

Next, functions of this first embodiment are described. In connecting the both housings 10, 30, the retainer 36 is moved to the full locking position to reliably retain the female terminal fittings 33 as shown in FIG. 4. In this state, the female housing 30 is inserted into the receptacle 12. In an inserting process, the pair of pressure receiving pins 39 enter the recesses 21 and come into contact with the upper surfaces of the resilient pressing pieces 22. When the female housing 30 is further inserted from this state, the resilient pressing pieces 22 are pushed by the pressure receiving pins 39 to be resiliently deflected downwardly and upward biasing forces are accumulated in the resilient pressing pieces 22. Thus, upward forces act on the retainer 36 by the biasing of these resilient pressing pieces 22. Since being in contact with the lower surface of the upper surface wall 15 of the receptacle 12, the upper surface of the retainer 36 is not displaced upwardly (toward the partial locking position).

When the both housings 10, 30 reach a properly connected state, the body portion 37 of the retainer 36 passes through the lock receiving portion 19 and reaches the front end of the cut portion 18. Then, the retainer 36 is pushed up from the full locking position to the partial locking position by upward biasing forces applied to the pressure receiving pins 39 from the resilient pressing pieces 22. Since this causes the body portion 37 of the retainer 36 to be locked to the lock receiving portion 19 from behind as shown in FIG. 5, a displacement of the female housing 30 forward of the receptacle 12 (i.e. in the separating direction) is restricted. That is, the both housings 10, 30 have the separation thereof restricted and are locked in a properly connected state.

Since the retainer 36 and the lock receiving portion 19 for locking the both housings 10, 30 in the connected state are accommodated inside the receptacle 12, a locked state of the retainer 36 and the lock receiving portion 19 cannot be visually confirmed from the outside of the male housing 10 (receptacle 12). Further, the connector A of this first embodiment is not provided with a resiliently deflectable lock arm used as a general locking means. Thus, general users cannot separate the both housings 10, 30 locked in the connected state.

When a mechanic separates the both housings 10, 30 such as for maintenance, a dedicated unlocking tool 40 is used. As shown in FIGS. 1 and 7, the unlocking tool 40 is an integral assembly of a base plate portion 41 extending long in the lateral direction and a pair of pressing projections 42 projecting from the lower surface of both left and right end parts of the base plate portion 41. The pair of pressing projections 42 are insertable into the pair of communication holes 20. Further, a projecting dimension of the pressing projections 42 is equal to or slightly larger than a maximum thickness of the upper surface wall 15 of the receptacle 12.

In separating the both housings 10, 30, the pair of pressing projections 42 are inserted into the pair of communication holes 20 from above the receptacle 12. In an inserting process, the lower ends of the pressing projections 42 come into contact with the upper surface of the body portion 37 of the retainer 36 pushed up to the partial locking position. If the pressing projections 42 are further inserted from this state, the retainer 36 is pushed down by the pressing projections 42 (unlocking tool 40). When the retainer 36 reaches the full locking position, the upper surface of the body portion 37 of the retainer 36 is at the same height as or lower than the lower surface of the upper surface wall 15. In this way, the locking of the retainer 36 and the lock receiving portion 19 is released and the both housings 10, 30 enter a separable state. Thereafter, if the female housing 30 is pulled out forwardly from the receptacle 12 with the retainer 36 moved to the full locking position by the unlocking tool 40, the both housings 10, 30 are separated.

As described above, the connector A of this first embodiment includes the male housing 10 including the receptacle 12, the female housing 30 to be connected to the male housing 10 by being inserted into the receptacle 12 and the retainer 36 and the lock receiving portion 19 provided on the male housing 10 and the female housing 30 and serving as the locking means for locking the both housings 10, 30 in the connected state. The locking of the retainer 36 and the lock receiving portion 19 is released by the unlocking tool 40 inserted into the receptacle 12.

In the connector A of this first embodiment, the locking means (retainer 36 and lock receiving portion 19) for locking the male and female housings 10, 30 in the connected state are accommodated inside the receptacle 12 and the locking structure thereof cannot be visually confirmed. Thus, general users who do not recognize the necessity of the unlocking tool 40 and general users who do not possess the unlocking tool 40 cannot separate the both housings 10, 30.

Further, the female housing 30 includes the housing body 31 for accommodating the female terminal fittings 33 and the retainer 36 relatively movable with respect to the housing body 31 and constituting the locking means. The retainer 36 is displaced to a position to be disengaged from the lock receiving portion 19 of the male housing 10 by the unlocking tool 40. According to this configuration, the both housings 10, 30 can be separated if the retainer 36 is disengaged from the lock receiving portion 19 by the unlocking tool 40.

Further, the housing body 31 is formed with the locking lances 34 for retaining and locking the accommodated female terminal fittings 33, and the retainer 36 also has a function of retaining the female terminal fittings 33 accommodated in the female housing 30. Thus, as compared to the case where a dedicated member for retaining the female terminal fittings 33 is provided separately from the means for locking the both housings 10, 30 in the connected state, the number of components is reduced.

Further, the resilient pressing pieces 22 for displacing the retainer 36 to the position where the retainer 36 is locked to the lock receiving portion 19 when the both housings 10, 30 are connected is provided in the receptacle 12. This causes the retainer 36 to be automatically locked to the lock receiving portion 19 due to resilient restoring forces of the resilient pressing pieces 22 when the both housings 10, 30 are connected. Therefore, a worker needs not perform an operation of displacing the retainer 36 to the position where the retainer 36 is locked to the lock receiving portion 19.

Next, a second specific embodiment of the present invention is described with reference to FIGS. 8 to 12. A connector B of this second embodiment is used as a means for connecting automotive wiring harnesses, a means for connecting a device and a wiring harness or the like and includes a male housing 50 and a female housing 60 connectable to and separable from each other. Note that, in the following description, front and rear sides are defined on the basis of the male housing 50 concerning a front-rear direction. Upper and lower sides shown in FIG. 9 are directly defined as upper and lower sides concerning a vertical direction.

Figure 8:
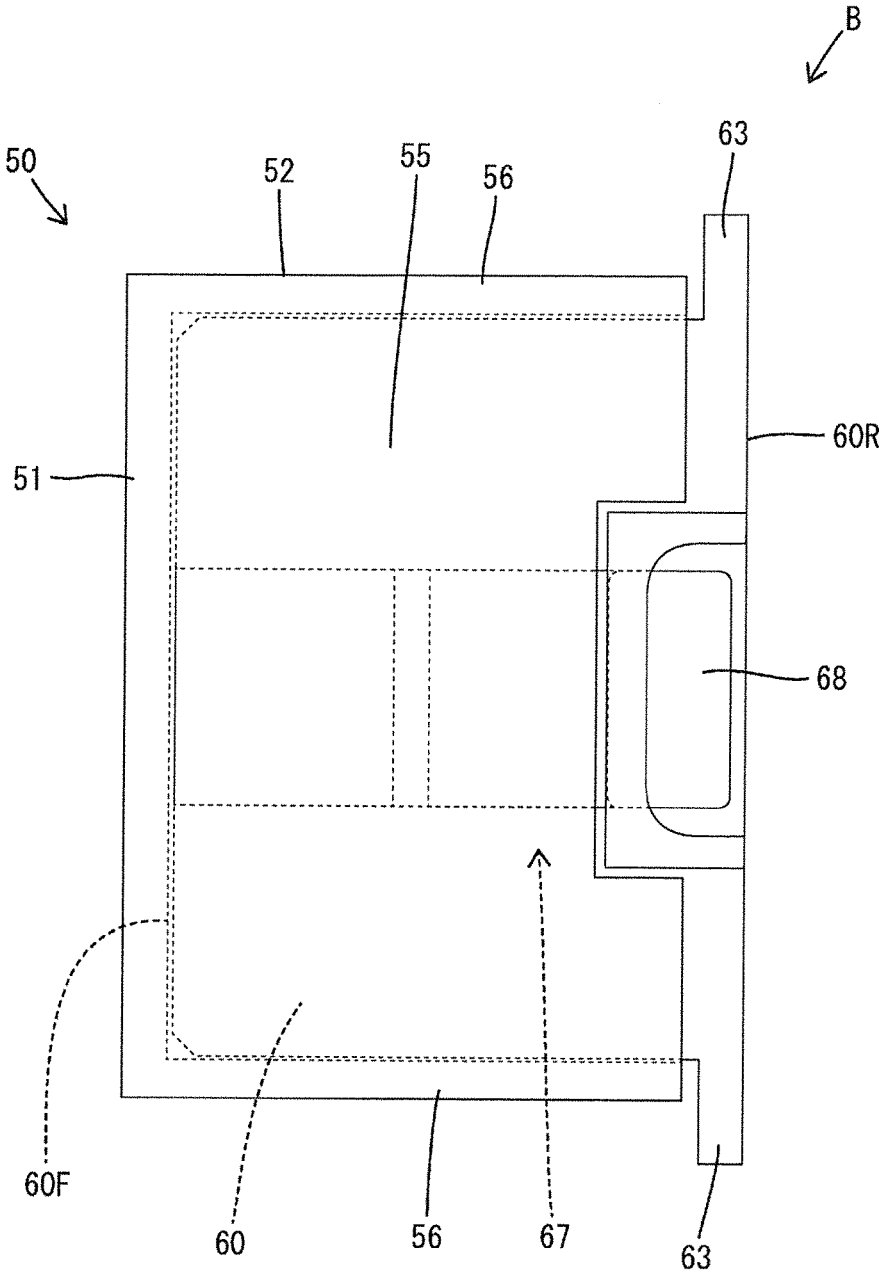
FIG. 8 is a plan view showing a state where a male housing and a female housing are connected in a connector of a second embodiment.
Figure 9:
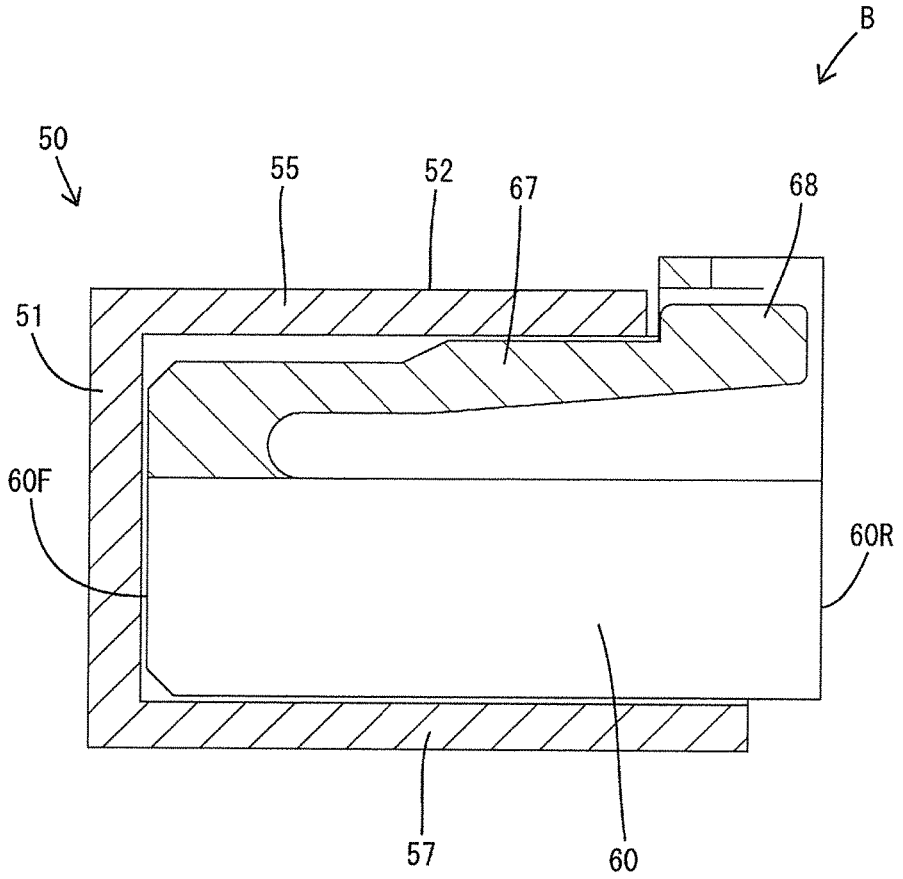
FIG. 9 is a side view in section showing a state where the male and female housings are connected.
Figure 10:
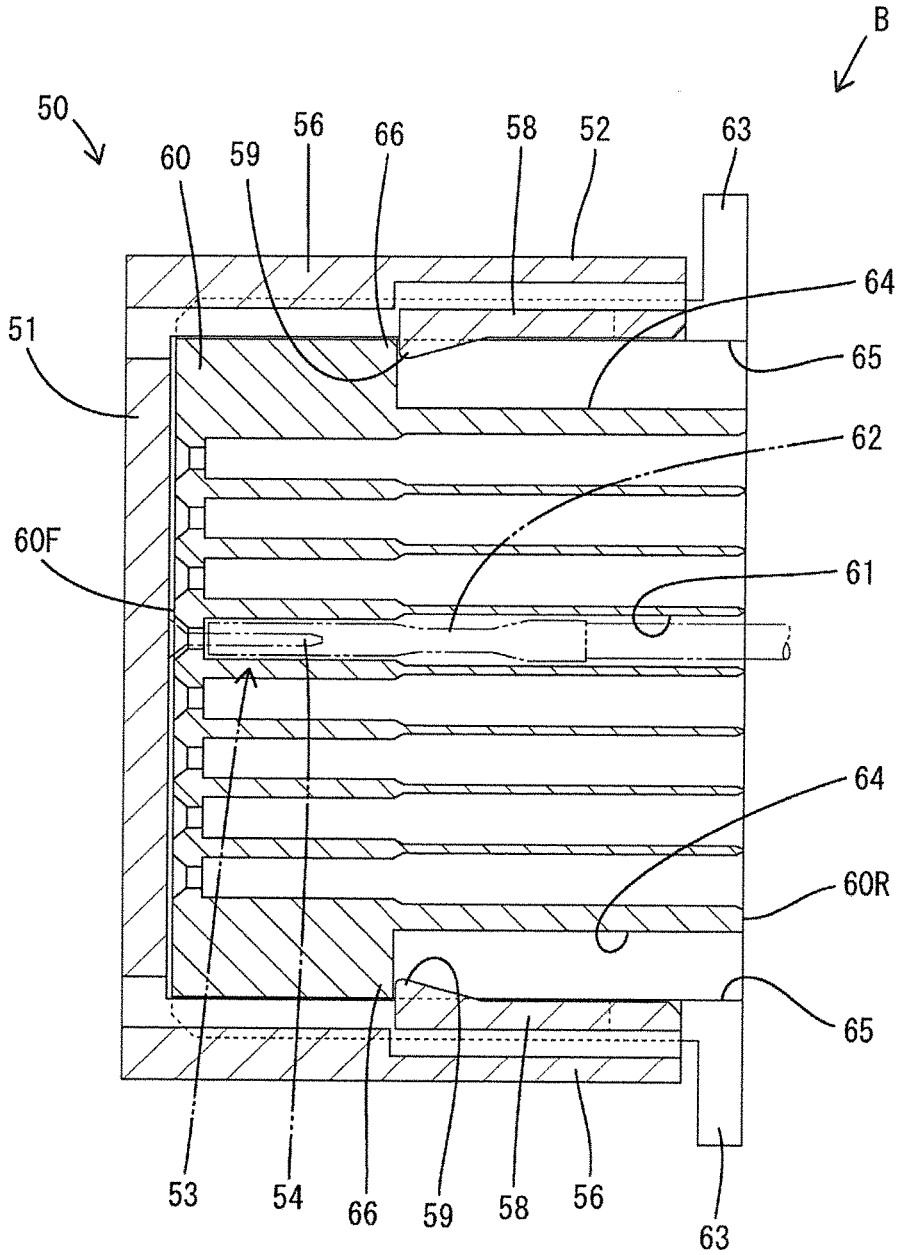
FIG. 10 is a plan view in section showing a locked state where the male and female housings are connected and resilient locking pieces and locking portions are locked.
Figure 11:
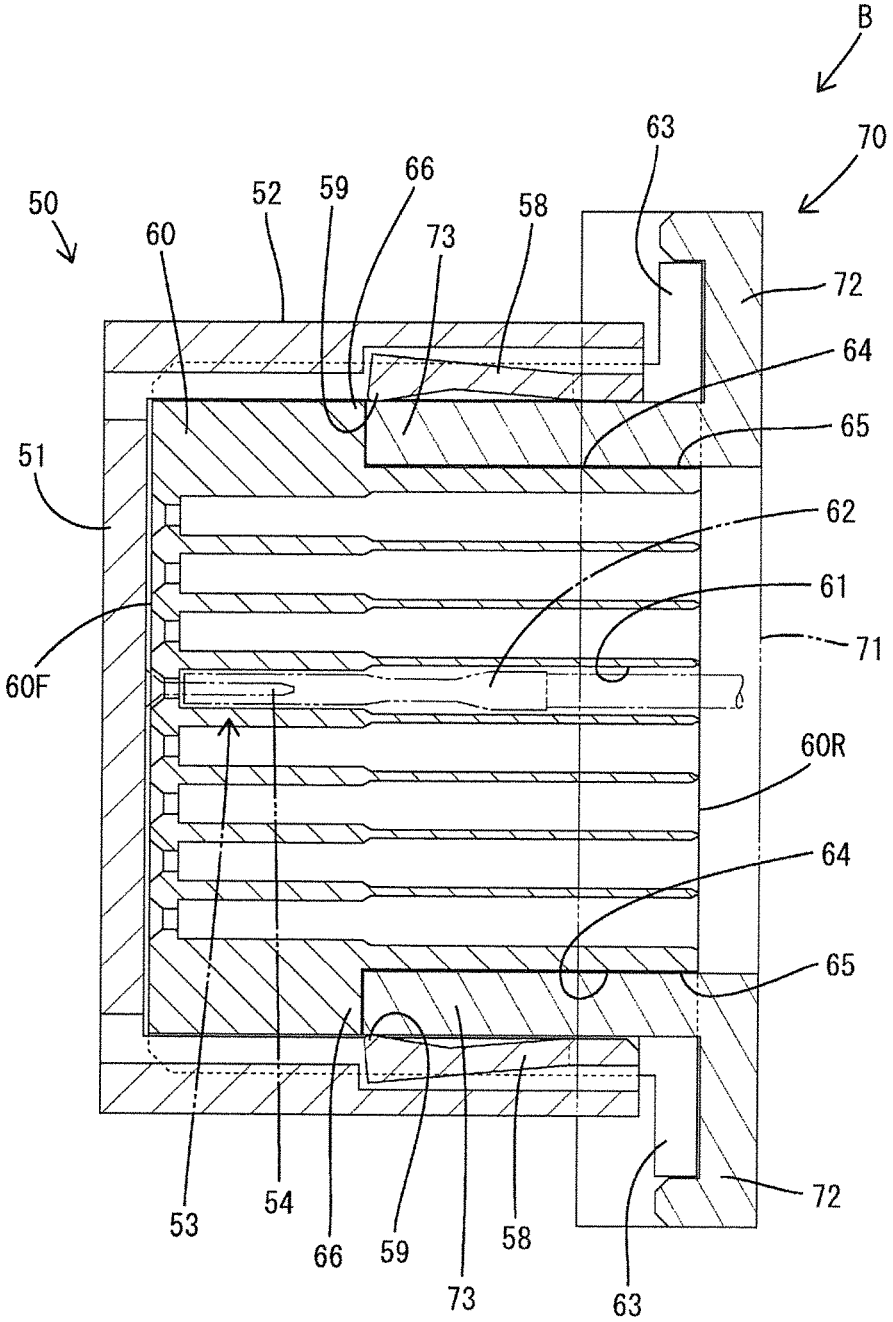
FIG. 11 is a plan view in section showing a state where the locking of the resilient locking pieces and the locking portions is released by an unlocking tool.
Figure 12:
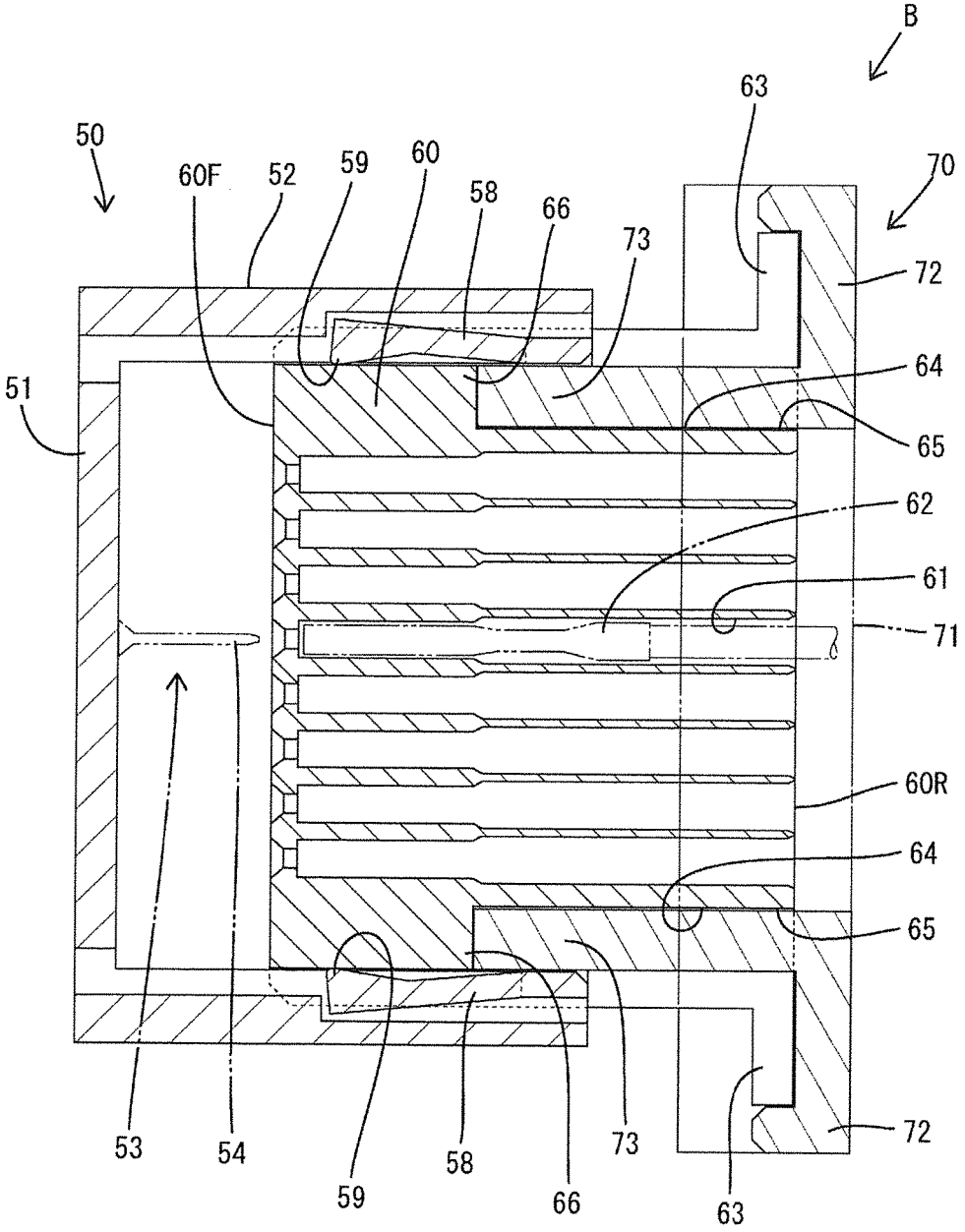
FIG. 12 is a plan view in section showing the process of integrally removing the unlocking tool and the female housing from a receptacle.

The male housing 50 is made of synthetic resin and an integral assembly of a block-shaped terminal holding portion 51 and a receptacle 52 in the form of a rectangular tube cantilevered forward from the outer peripheral edge of the front end of the terminal holding portion 51 as shown in FIGS. 8 to 12. As shown in FIGS. 10 to 12, a plurality of male terminal fittings 53 of a known form are mounted in the terminal holding portion 51. The male terminal fitting 53 is formed with a long and narrow tab 54 on a front end part. The tab 54 projects into the receptacle 52 from the front surface of the terminal holding portion 51.

As shown in FIGS. 8 to 10, the receptacle 52 is formed into a bilaterally symmetrical rectangular tube shape by an upper surface wall 55, both left and right side surface walls 56 and a lower surface wall 57. As shown in FIGS. 10 to 12, a pair of bilaterally symmetrical resilient locking pieces 58 (locking means as claimed) cantilevered rearward are formed on inner side surfaces of the both left and right side surface walls 56. An inner side surface of an extending end part (rear end part) of each resilient locking piece 58 is caused to project, thereby forming a locking projection 59. The resilient locking piece 58 is resiliently deflectable in a lateral direction (direction intersecting with an inserting direction and a removing direction of the female housing 60 into and from the receptacle 52) with a front end part (base end part) thereof serving as a supporting point.

The female housing 60 is made of synthetic resin and connected to the male housing 50 with a front surface 60F thereof facing the front surface of the male housing 50 (opening surface of the receptacle 52). As shown in FIGS. 10 to 12, a plurality of female terminal fittings 62 of a known form are respectively inserted into a plurality of terminal accommodating chambers 61 formed in the female housing 60 to be connected to the tabs 54 of the male terminal fittings 53. The female terminal fitting 62 accommodated in the terminal accommodating chamber 61 is retained and held by a locking action of a locking lance (not shown) of a known form. A pair of bilaterally symmetrical finger placing portions 63 are formed to protrude outward in the lateral direction from both left and right side edges of a back surface 60R of the female housing 60.

As shown in FIGS. 10 to 12, both left and right outer side surfaces of the female housing 60 are recessed, thereby forming a pair of bilaterally symmetrical groove portions 64. The groove portions 64 extend in the front-rear direction (direction parallel to the inserting direction and the removing direction of the female housing 60 into and from the receptacle 52). A formation range of the groove portions 64 in the front-rear direction is an area from a position behind the front surface 60F of the female housing 60 to the back surface 60R of the female housing 60. An insertion opening 65 for opening end parts of the groove portions 64 on the side of the back surface 60R is open in the back surface 60R of the female housing 60. Stepped parts of the both left and right outer side surfaces of the female housing 60 constituting end surfaces of the groove portions 64 on the side of the front surface 60F serve as locking portions 66 (locking means as claimed).

Further, as shown in FIGS. 8 and 9, the female housing 60 is formed with a dummy lock arm 67. The dummy lock arm 67 is cantilevered rearward from an end part of the upper surface of the female housing 60 on the side of the front surface 60F. The dummy lock arm 67 is resiliently deflectable in the vertical direction (direction intersecting with the inserting direction of the female housing 60 into the receptacle 52) with a base end part thereof serving as a supporting point. A pseudo-unlocking portion 68 is formed on an extending end part of the dummy lock arm 67 (end part on the side of the back surface 60R). The pseudo-unlocking portion 68 is shaped to be easily operable by a worker's finger. If the pseudo-unlocking portion 68 is pushed, the dummy lock arm 67 is resiliently deflectable downwardly.

Next, functions of this second embodiment are described. In connecting the both housings 50, 60, the female housing 60 is inserted into the receptacle 52. In an inserting process, the both left and right outer side surfaces of the female housing 60 interfere with the locking projections 59, whereby the resilient locking pieces 58 are resiliently deflected in the lateral direction away from the female housing 60. When the both housings 50, 60 reach a properly connected state, the locking portions 66 pass through the locking projections 59. Thus, the resilient locking pieces 58 resiliently return inwardly in the lateral direction. Associated with this, the locking projections 59 enter the groove portions 64 and are locked to the locking portions 66 from front, wherefore a displacement of the female housing 60 forward of the receptacle 52 (i.e. in the separating direction) is restricted. That is, the both housings 50, 60 have the separation thereof restricted and are locked in the properly connected state.

Since the resilient locking pieces 58 (locking projections 59) and the locking portions 66 for locking the both housings 50, 60 in the connected state are accommodated inside the receptacle 52, a locked state of the resilient locking pieces 58 and the locking portions 66 cannot be visually confirmed from the outside of the male housing 50 (receptacle 52). Thus, general users who do not recognize a locking structure by the resilient locking pieces 58 and the locking portions 66 cannot release locking.

Note that, with the both housings 50, 60 properly connected, the pseudo-unlocking portion 68 of the dummy lock arm 67 is exposed to be easily seen near the front end of the receptacle 52. However, since the dummy lock arm 67 is not locked to the male housing 50 (receptacle 52), a locking function for restricting the separation of the both housings 50, 60 is not exhibited. Thus, even if the pseudo-unlocking portion 68 is pushed, the both housings 50, 60 locked in the connected state cannot be separated.

When a mechanic separates the both housings 50, 60 such as for maintenance, a dedicated unlocking tool 70 is used. The unlocking tool 70 is an integral assembly of a base plate portion 71 extending long in the lateral direction, a pair of bilaterally symmetrical finger contact portions 72 extending downward from the lower surfaces of both left and right end parts of the base plate portion 71 and a pair of bilaterally symmetrical unlocking projections 73 cantilevered from the finger contact portions 72. A projecting direction of the unlocking projections 73 is the same as the inserting direction of the female housing 60 into the receptacle 52.

In separating the both housings 50, 60, the unlocking tool 70 is brought closer from the side of the back surface 60R of the female housing 60 and the pair of unlocking projections 73 are inserted into the groove portions 64 through the insertion opening 65. When the finger contact portions 72 come into contact with the finger placing portions 63 of the female housing 60, the unlocking projections 73 interfere with the locking projections 59 to resiliently deflect the resilient locking pieces 58 outwardly in the lateral direction. In this way, the resilient locking pieces 58 (locking projections 59) and the locking portions 66 are disengaged, and a locked state by the locking of the resilient locking pieces 58 and the locking portions 66 is released. This makes the both housings 50, 60 separable. Thereafter, if the worker places fingers on both the finger contact portions 72 and the finger placing portions 63 held in contact and integrally pulls the unlocking tool 70 and the female housing 60 toward the back surface 60R, the both housings 50, 60 are separated.

As described above, the connector B of this second embodiment includes the male housing 50 including the receptacle 52, the female housing 60 to be connected to the male housing 50 by being inserted into the receptacle 52 and the locking means provided on the male housing 50 and the female housing 60 and configured to lock the both housings 50, 60 in the connected state by being locked inside the receptacle 52. The locking means include the resilient locking pieces 58 formed on the inner surface of the receptacle 52 and the locking portions 66 formed on the outer surface of the female housing 60. The locking of the resilient locking pieces 58 and the locking portions 66 is released by the unlocking tool 70 inserted into the receptacle 52. That is, the resilient locking pieces 58 are resiliently deflected in directions to be disengaged from the locking portions 66 by the unlocking tool 70.

In the connector B of this second embodiment, the locking means (resilient locking pieces 58 and locking portions 66) for locking the male and female housings 50, 60 in the connected state are accommodated inside the receptacle 52 and the locking structure thereof cannot be visually confirmed. Thus, general users who do not recognize the necessity of the unlocking tool 70 and general users who do not possess the unlocking tool 70 cannot separate the both housings 50, 60.

Further, the unlocking tool 70 releases the locking of the resilient locking pieces 58 and the locking portions 66 by being displaced in the same direction as the inserting direction of the female housing 60 into the receptacle 52. According to this configuration, after the unlocking tool 70 is inserted into the receptacle 52 and the locking of the resilient locking pieces 58 and the locking portions 66 is released, the unlocking tool 70 and the female housing 60 can be integrally separated from the receptacle 52. Thus, as compared to the case where the unlocking tool 70 is removed from the receptacle 52 separately from the female housing 60, man-hours of work are reduced.

Further, the dummy lock arm 67 configured not to lock the male housing 50 is formed on the outer surface of the female housing 60 and, with the male housing 50 and the female housing 60 connected, the pseudo-unlocking portion 68 formed on the dummy lock arm 67 is exposed. Since the dummy lock arm 67 is not locked to the male housing 50, even if a general user operates the pseudo-unlocking portion 68 for the purpose of separating the both housings 50, 60, the both housings 50, 60 cannot be separated.

The present invention is not limited to the above described and illustrated embodiments. For example, the following embodiments are also included in the technical scope of the present invention.

Although the retainer having also the function of retaining the female terminal fittings is used as the movable locking member in the above first embodiment, a dedicated retaining member (retainer) for retaining the female terminal fittings may be provided separately from the movable locking member.

In the above first embodiment, the retainer (movable locking member) is caused to lock the lock receiving portion (locking means on the male housing side) by the resilient pressing pieces when the both housings are connected. However, the resilient pressing pieces may not be provided and a worker may displace the movable locking member to the position where the movable locking member is locked to the lock receiving portion.

In the above first embodiment, a dummy lock arm similar to that of the second embodiment may be provided.

Although the moving direction of the unlocking tool during unlocking is the same as the inserting direction of the female housing into the receptacle in the above second embodiment, the moving direction of the unlocking tool during unlocking may be a direction intersecting with the inserting direction of the female housing into the receptacle.

In the above second embodiment, the dummy lock arm is resiliently deflected when the pseudo-unlocking portion is operated. However, the dummy lock arm may not be resiliently deflected even if the pseudo-unlocking portion is operated.

Although the pseudo-unlocking portion is formed on the dummy lock arm in the above second embodiment, the dummy lock arm may not be provided and the pseudo-unlocking portion may be integrally formed to the receptacle.

Although the dummy lock arm is provided in the above second embodiment, the dummy lock arm may not be provided.

LIST OF REFERENCE SIGNS

A . . . connector
10 . . . male housing
12 . . . receptacle
19 . . . lock receiving portion (locking means)
22 . . . resilient pressing piece
30 . . . female housing
31 . . . housing body
33 . . . female terminal fitting
34 . . . locking lance
36 . . . retainer (movable locking member, locking means)
40 . . . unlocking tool
B . . . connector
50 . . . male housing
52 . . . receptacle
58 . . . resilient locking piece (locking means)
60 . . . female housing
66 . . . locking portion (locking means)
67 . . . dummy lock arm
68 . . . pseudo-unlocking portion
70 . . . unlocking tool

The invention claimed is:

1. A connector, comprising:

a male housing including a receptacle;

a female housing to be connected to the male housing by being inserted into the receptacle; and locks provided on the male housing and the female housing and configured to lock the female housing in the receptacle of the male housing in a connected state;

wherein:

the locks are configured to be released by an unlocking tool inserted into the receptacle;

the female housing includes a housing body for accommodating a female terminal fitting and a movable locking member relatively movable with respect to the housing body and constituting the lock of the female housing; and the movable locking member is accommodated closer to a back side of the receptacle than the lock on the male housing and is displaced to a position to be disengaged from the lock on the male housing side by the unlocking tool.

2. A connector, comprising:

a male housing including a receptacle;

a female housing to be connected to the male housing by being inserted into the receptacle; and locks provided on the male housing and the female housing and configured to lock the female housing in the receptacle of the male housing in a connected state;

wherein:

the locks are configured to be released by an unlocking tool inserted into the receptacle;

the female housing includes a housing body for accommodating a female terminal fitting and a movable locking member relatively movable with respect to the housing body and constituting the lock of the female housing;

the movable locking member is displaced to a position to be disengaged from the lock on the male housing by the unlocking tool;

the housing body is formed with a locking lance for retaining and locking the accommodated female terminal fitting; and the movable locking member is configured to retaining the female terminal fitting in the female housing.

3. A connector, comprising:

a male housing including a receptacle;

a female housing to be connected to the male housing by being inserted into the receptacle; and locks provided on the male housing and the female housing and configured to lock the female housing in the receptacle of the male housing in a connected state;

wherein:

the locks are configured to be released by an unlocking tool inserted into the receptacle;

the female housing includes a housing body for accommodating a female terminal fitting and a movable locking member relatively movable with respect to the housing body and constituting the lock of the female housing;

the movable locking member is displaced to a position to be disengaged from the lock of the male housing by the unlocking tool; and a resilient pressing piece in the receptacle for displacing the movable locking member to a position where the movable locking member is locked to the lock of the male housing when the male and female housings are connected.

4. A connector, comprising:

a male housing including a receptacle;

a female housing to be connected to the male housing by being inserted into the receptacle; and locks provided on the male housing and the female housing and configured to lock the female housing in the receptacle of the male housing in a connected state;

wherein:

the locks are configured to be released by an unlocking tool inserted into the receptacle;

the locks include a resilient locking piece formed on an inner surface of the receptacle and a locking portion formed on an outer surface of the female housing;

the resilient locking piece is resiliently deflected in a direction to be disengaged from the locking portion by the unlocking tool;

the unlocking tool releases the locking of the resilient locking piece and the locking portion by being displaced in the same direction as an inserting direction of the female housing into the receptacle; and the unlocking tool is removable from the receptacle together with the female housing after the locking is released, a finger placing portion protruding in a direction intersecting with a removing direction of the female housing from the receptacle is provided on a back surface of the female housing.

5. A connector, comprising:

a male housing including a receptacle;

a female housing to be connected to the male housing by being inserted into the receptacle; and locks provided on the male housing and the female housing and configured to lock the male housing and the female housing in a connected state by being locked inside the receptacle;

wherein:

the locks are configured to be released by an unlocking tool inserted into the receptacle;

a dummy lock arm configured not to lock the male housing is formed on an outer surface of the female housing; and a pseudo-unlocking portion formed on the dummy lock arm is exposed with the male housing and the female housing connected.

* * * * *